US010078310B2

(12) United States Patent
Sarchi et al.

(10) Patent No.: US 10,078,310 B2
(45) Date of Patent: Sep. 18, 2018

(54) TIMEPIECE COMPRISING A DEVICE FOR SWITCHING A MECHANISM OF SAID TIMEPIECE

(71) Applicant: Montres Breguet S.A., L'Abbaye (CH)

(72) Inventors: Davide Sarchi, Zurich (CH); Benoit Legeret, Ecublens (CH); Deirdre Lenoir, Le Sentier (CH); Jean-Philippe Rochat, Les Bioux (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/634,319

(22) Filed: Jun. 27, 2017

(65) Prior Publication Data

US 2018/0004165 A1 Jan. 4, 2018

(30) Foreign Application Priority Data

Jul. 1, 2016 (EP) ..... 16177616

(51) Int. Cl.
*G04B 11/00* (2006.01)
*G04C 13/04* (2006.01)
*G04F 7/08* (2006.01)

(52) U.S. Cl.
CPC ..... *G04C 13/0409* (2013.01); *G04B 11/005* (2013.01); *G04F 7/0842* (2013.01)

(58) Field of Classification Search
CPC ... G04C 13/0409; G04C 13/04; G04F 7/0842; G04F 7/08; G04B 11/005; G04B 11/00; G04B 11/001
See application file for complete search history.

(56) References Cited

U.S. PATENT DOCUMENTS 2,893,257 A * 7/1959 Schulte ..... F16H 49/005 74/29
3,168,690 A 2/1965 Lavet et al.
(Continued)

FOREIGN PATENT DOCUMENTS

| | | |
|---|---|---|
| EP | 2 015 145 A1 | 1/2009 |
| FR | 1.090.564 | 3/1955 |
| FR | 1.276.734 | 11/1961 |

OTHER PUBLICATIONS

European Search Report dated Jan. 3, 2017 in European Application 16177616.6 filed on Jul. 1, 2016 (with English Translation of Categories of cited documents).

*Primary Examiner* — Sean Kayes
(74) *Attorney, Agent, or Firm* — Oblon, McClelland, Maier & Neustadt, L.L.P.

(57) ABSTRACT

The vertical coupling/uncoupling device includes a switching member and a control member, the latter being arranged to pivot about an axis of rotation to be able to be driven in rotation step-by-step successively into a plurality of distinct angular positions. The control member and the switching member respectively include a first magnetic structure and a second magnetic structure arranged to exhibit a magnet interaction therebetween. These first and second magnetic structures are arranged such that, depending on the angular position of the control member, a first magnetic force or a second magnetic force is produced, these first and second magnetic forces being oriented along said axis of rotation but in opposite directions. The switching member is subjected to an alternate movement between its first and second stable axial positions when the second magnetic structure is driven in rotation step-by-step in said given direction of rotation.

17 Claims, 5 Drawing Sheets

(56) References Cited

U.S. PATENT DOCUMENTS

| | | | | | |
|---|---|---|---|---|---|
| 3,462,942 | A | | 8/1969 | Meitinger et al. | |
| 3,695,035 | A | * | 10/1972 | Cleusix | G04B 27/001 368/191 |
| 3,708,974 | A | * | 1/1973 | Fujimori | G04B 15/12 368/128 |
| 3,969,888 | A | * | 7/1976 | Veuilleumier | G04B 19/24 368/35 |
| 2008/0304370 | A1 | | 12/2008 | Scheufele | |
| 2017/0300015 | A1 | * | 10/2017 | Winkler | G04C 5/005 |

* cited by examiner

TIMEPIECE COMPRISING A DEVICE FOR SWITCHING A MECHANISM OF SAID TIMEPIECE

This application claims priority from European patent application No. 16177616.6 filed Jul. 1, 2016, the entire disclosure of which is hereby incorporated herein by reference.

FIELD OF THE INVENTION

The present invention concerns a device for switching a timepiece mechanism between two operational states.

More particularly, the invention concerns a timepiece comprising:

- a timepiece mechanism capable of switching between a specific first state and a specific second state;
- a switching device arranged to be able to switch the timepiece mechanism between the first and second states, said switching device including a control member, which extends in a general plane in which it is subjectable to a movement under the action of an actuation device of said control member, and a switching member at least one part of which is arranged to be subjectable to a movement having a component orthogonal to the general plane.

The switching device is of the bistable type. It is arranged so that said at least one part of the switching member is capable of passing on demand from a first stable axial position to a second stable axial position, to cause a first switch of the timepiece mechanism between its first state and its second state, and from the second stable axial position to the first stable axial position to cause a second switch of the timepiece mechanism between its second state and its first state.

The timepiece mechanism may have several different functions for which the switching device defines a bistable switch, alternately making it possible to start or stop the function or alternatively to couple and uncouple this function.

BACKGROUND OF THE INVENTION

A bistable vertical coupling device described in EP Patent 2015145 meets the definition of the device given in the field of the invention. This device is provided for alternately starting and then stopping a chronograph mechanism. It includes for such purpose a switching mechanism including a coupling wheel permanently coupled to an output wheel, a coupling cone associated with a control member, a spring exerting an axial force between the first wheel and a plate forming a stop, a central tube for joining the plate to the assembly formed of the coupling wheel and the coupling cone, and finally a joint allowing friction coupling of said assembly to an input wheel.

The switching mechanism is actuated axially (i.e. perpendicularly to the respective planes of the input wheel and of the output wheel) by a control mechanism, which includes a clamp with two fingers, carrying, at their respective free ends, portions that each have an oblique surface for pressing laterally on the coupling cone (which consequently defines an uncoupling cone), and a column wheel which is driven step-by-step into a plurality of angular positions by means of an actuation device, notably a push-piece actuatable by the timepiece user. This column wheel actuates the clamp, in collaboration with a strip-spring, to alternately lift the assembly formed of the coupling wheel and the coupling cone against the axial force of the spring and uncouple the chronograph mechanism and remove the lateral pressure on this assembly in order to couple the chronograph mechanism, this coupling being achieved by the spring and the friction joint.

As is clear from the description above, the vertical coupling device of EP2015145 is relatively complex. Firstly, it requires a spring incorporated in the switching mechanism. Next, it occupies a lot of space in the general plane of the movement and it has quite a large height, due to the superposition of several elements, particularly of the coupling cone, the spring and the stop-plate. Finally, the control mechanism is not easy to fabricate and then assemble inside the timepiece movement.

SUMMARY OF THE INVENTION

The invention proposes to provide a switching device, in particular a bistable coupling device, of a novel type compared to that of the prior art described above, notably to overcome the drawbacks of this prior art.

To this end, the invention concerns a timepiece as defined in the main claim of the appended set of claims. Thus, the invention concerns a timepiece generally defined in the field of the invention and which is characterized in that:

- the control member is arranged to pivot about an axis of rotation which is perpendicular to its general plane, so as to be drivable step-by-step in a given direction of rotation, successively into a plurality of distinct angular positions;
- the control member and the switching member respectively include a first magnetic structure and a second magnetic structure arranged to exhibit a magnet interaction therebetween;
- one of the first and second magnetic structures includes at least a first magnetic pole and the other of these two magnetic structures includes at least a second magnetic pole and a third magnetic pole with opposite polarities, the first and second magnetic structures being arranged such that, in a first angular position of the control member of said plurality of distinct angular positions, the first magnetic pole mainly exhibits a first magnetic interaction with one of the second and third magnetic poles, and such that, in a second angular position of this control member of the plurality of distinct angular positions, this first magnetic pole mainly exhibits a second magnetic interaction with the other of the second and third magnetic poles, the first and second magnetic interactions producing on the switching member a first magnetic force and a second magnetic force respectively, both mainly oriented along said axis of rotation in opposite directions, making it possible to move said at least one part of the switching member from the first stable axial position to the second stable axial position and vice versa;
- said at least one part of the switching member is subjected to an alternate movement between its first and second stable axial positions when the second magnetic structure is driven in step-by-step rotation in said given direction of rotation.

As a result of the features of the invention, the switching member can switch alternately between its two stable axial positions as a result of a magnetic force alternately produced in both senses of the axial direction by the two magnetic structures, respectively forming the control member and the switching member, when the control member is driven successively step-by-step into a plurality of predefined angular positions. Other particular advantages of the present invention will appear from the following description of the invention.

Various embodiments and variants form the subject of secondary claims of the appended set of claims. Thus, notably, in a particular embodiment, the switching member includes axial guiding arranged to allow an axial translation in both directions of this switching member when the control member is actuated in rotation and to prevent the switching member being driven in rotation upon such actuation. In a particular application, the switching device forms a coupling/uncoupling device. The switching member carries a coupling element arranged to rotate freely, at least in one axial position of the first and second stable axial positions, corresponding to a coupled state of the switching device and thus of the associated timepiece mechanism, the coupling element being integral with the switching member in axial translation.

BRIEF DESCRIPTION OF THE DRAWINGS

The invention will be described below with reference to the annexed drawings, given by way of non-limiting example, and in which.

DETAILED DESCRIPTION OF THE INVENTION

Figure 1:
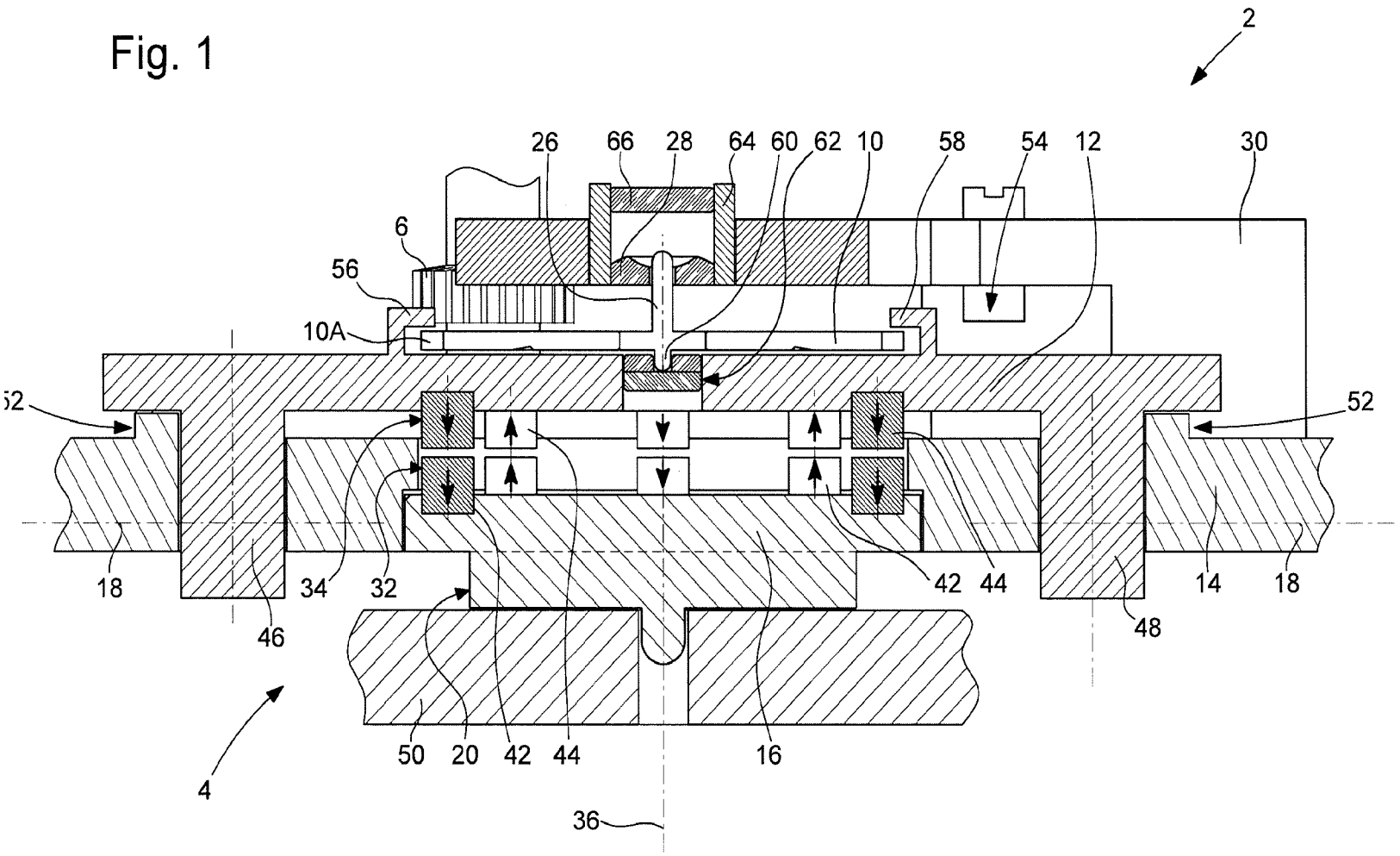
FIG. 1 is a partial cross-sectional view of a timepiece according to a first embodiment of the invention.

A first embodiment of a timepiece according to the invention will be described with reference to FIGS. 1 to 3. This timepiece 2 is partially represented in the Figures which essentially show a switching device 4 for this timepiece and a pinion 6 and a wheel 8 of a timepiece mechanism which, operationally, may be in a first state, where the wheel and pinion are not mechanically coupled, and a second state, where the wheel and pinion are mechanically coupled by a coupling wheel 10 associated with the switching device. The coupling wheel includes a central arbor 26 and is arranged to rotate freely in at least one of its first and second stable axial positions which corresponds to a coupled state of the switching device, this coupling wheel being integral with the switching member in axial translation. The switching device defines here a vertical coupling/uncoupling device since switching member 12, carrying the coupling wheel, is subjected therewith to a vertical movement of translation in both directions, i.e. perpendicular to general plane 18 of base 14 on which control member 16 is mounted and parallel to the respective axes of rotation of pinion 6 and of wheel 8. In the first embodiment described here, one part of arbor 26 located on the side opposite the switching member relative to the coupling wheel toothing 10A, is arranged to slide in a jewel hole 28 forming a bearing mounted in a bar 30 integral with base 14.

Switching device 4 is arranged to be able to switch the timepiece mechanism between its first and second states. To this end, it includes a control member 16, which extends in a general plane 18 in which it is subjectable to a pivoting motion (rotation on itself) under the action of an actuation device (partially represented in FIG. 3), and switching member 12, arranged to be subjectable to a movement of translation in a direction substantially orthogonal to general plane 18. The control member can be driven in rotation, about its central axis of rotation 36, step-by-step in a given direction of rotation successively into a plurality of distinct angular positions which are predetermined. To achieve this, in the variant represented in FIG. 3, the control member includes a star 20 associated with a jumper 22, which successively stabilises the control member in the angular positions of the plurality of distinct angular positions. The star is driven in rotation successively into said angular positions by an actuation device including a lever or finger 24 acting successively on the branches of the star, which includes a number of branches equal to the number of these angular positions. This number is equal to eight in the variant described. The lever or finger can be actuated in various manners, either by a user or by another mechanism of the timepiece. In particular, it can be actuated by a push-piece arranged inside a watch case. As a result of the magnetic system that will be described hereinafter, the switching member is capable of passing on demand from a first stable axial position to a second stable axial position, to cause a first switch of the timepiece mechanism between its first state, represented in FIG. 1, and its second state, and from the second stable axial position to the first stable axial position to cause a second switch of the timepiece mechanism between its second state and its first state.

According to the invention, the control member and the switching member respectively include a first magnetic structure 32 and a second magnetic structure 34 exhibiting a magnetic interaction therebetween. Generally, one of the first and second magnetic structures, includes at least a first magnetic pole and the other of these two magnetic structures includes at least a second magnetic pole and a third magnetic pole with opposite polarities. The first and second magnetic structures are arranged such that, in a first angular position of the control member of the plurality of its distinct angular positions, the first magnetic pole mainly exhibits a first magnetic interaction with one of the second and third magnetic poles and such that, in a second angular position of this control member of the plurality of distinct angular positions, this first magnetic pole mainly exhibits a second magnetic interaction with the other of the second and third magnetic poles. The first and second magnetic interactions produce on the switching member a first magnetic force and a second magnetic force respectively, both oriented along axis of rotation 36 of the control member in opposite senses, which makes it possible to move the switching member from its first stable axial position to its second stable axial position and vice versa. More particularly, the first and second magnetic structures are arranged such that the switching member is subjected to an alternate movement between its first and second stable axial positions when the second magnetic structure, integral with the control member, is driven in rotation step-by-step in said given direction of rotation, which thus makes it possible, on demand, to switch the timepiece mechanism between its first and second states.

The rotating control member is arranged to make steps each corresponding to a pivoting motion of angle $\pi/N$, with $N>0$, such that first magnetic structure 32 is made to occupy in succession 2N distinct angular positions about axis of rotation 36. Generally, in such a case, one of the first and second magnetic structures includes N first active magnetic poles, which are substantially axially oriented and, when N>1, regularly distributed around axis of rotation 36, whereas the other of these two magnetic structures includes N second active magnetic poles and N third active magnetic poles which are substantially axially oriented and regularly distributed around the axis of rotation and at substantially the same distance from this axis of rotation as the first magnetic poles. The second and third magnetic poles are arranged alternately, such that each second magnetic pole is inserted between two third magnetic poles. Further, in each of the distinct angular positions of the control member, the N first magnetic poles are located substantially facing the N second magnetic poles or N third magnetic poles. In the variant represented in the Figures, N is equal to four (N=4). An "active" magnetic pole means a magnetic pole participating in the magnetic interaction provided in the magnetic system causing axial translations in both directions of the switching member.

Figure 2:
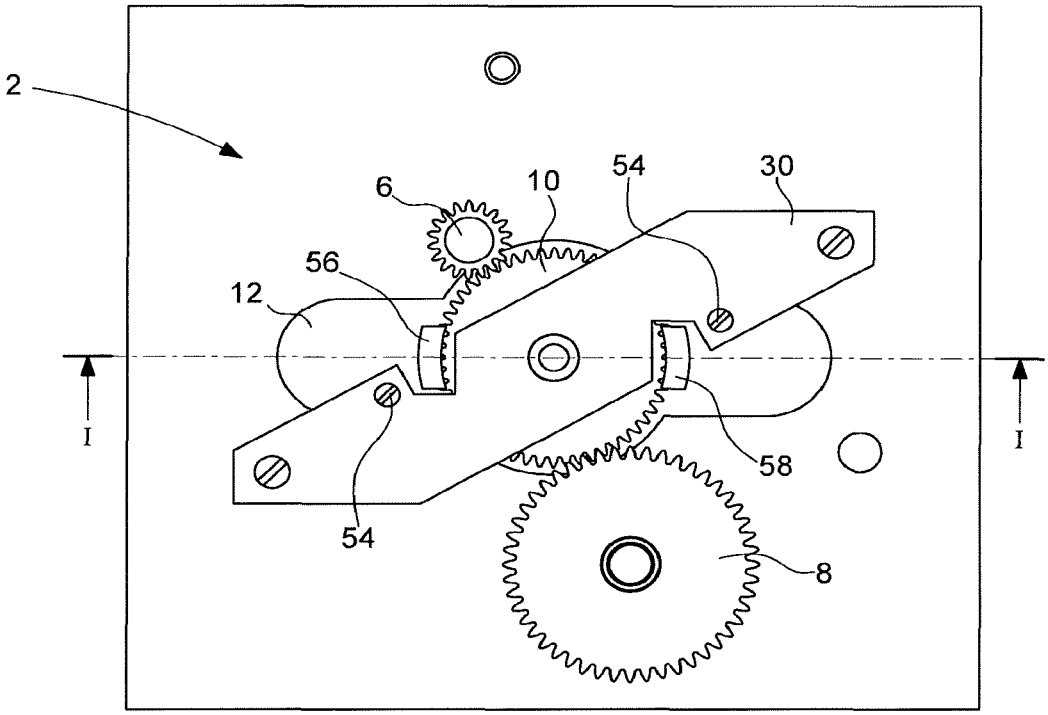
FIG. 2 is a partial top view of the timepiece of FIG. 1.
Figure 3:
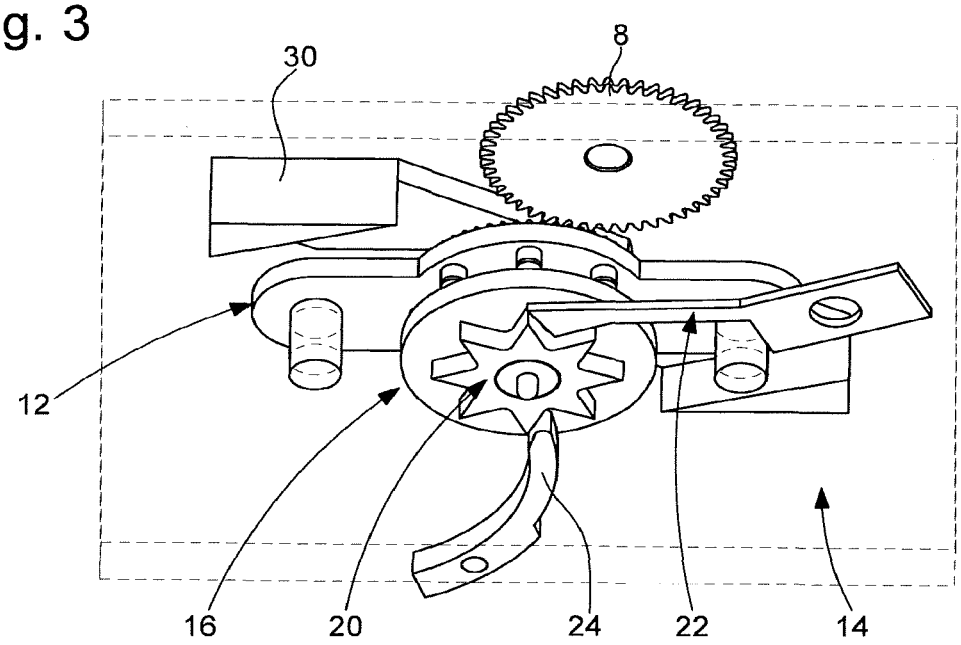
FIG. 3 is a perspective view from underneath the switching device of the timepiece of FIG. 1.

In the variant represented in FIGS. 1 to 3, the magnetic structure including the N first active magnetic poles further includes N fourth active magnetic poles of opposite polarity to that of the N first active magnetic poles, the first and fourth magnetic poles being regularly distributed about axis of rotation 36 and arranged alternately such that each fourth magnetic pole is inserted between two first magnetic poles. Thus, the first and second magnetic structures are similar and exhibit materially between them a planar symmetry in the various stable angular positions of the control member (depending upon the stable angular position of the control member, the polarities of the active poles facing each other may either be opposite or identical).

In a main variant, represented in FIGS. 1 to 3, each of the first and second magnetic structures includes 2N bipolar magnets 42, 44 respectively, axially oriented and regularly distributed about axis of rotation 36, these bipolar magnets being alternately magnetically oriented in one sense and then the other (i.e. the magnetic axes of two adjacent bipolar magnets have opposite senses). It will be noted that, in a variant (not represented) wherein the magnetic structure carrying the N first active magnetic poles does not have fourth active magnetic poles, this magnetic structure then includes N axially oriented bipolar magnets, with their respective magnetic axes having the same sense, and regularly distributed about the axis of rotation.

In a variant (not represented), at least the magnetic structure carrying the second and third magnetic poles is formed by a multipolar magnet including 2N active poles which are alternated and axially oriented. It will be noted that the other magnetic structure may also be formed by a multipolar magnet with axially oriented poles, in particular when it also includes 2N alternate active poles.

The switching member includes axial guiding arranged to allow an axial translation in both directions of the switching member when the control member is actuated in rotation and to prevent the switching member being driven in rotation upon such actuation. In the first embodiment, switching member 12 is guided in axial translation (along axis of rotation 36) by at least a first column 46 located at the periphery of the control member and sliding into an aperture in base 14. Preferably, a second column 48 is also provided here for axial guiding, the first and second columns being advantageously diametrically opposite relative to the axis of rotation, as represented in FIGS. 1 and 3. Moreover, control member 16 is arranged to be able to pivot, as already explained, but not subjectable to a substantially axial translation. To this end, the control member has a part having an outer lateral wall which is circular, this part being arranged inside a circular recess in base 14, which has an axial stop for this part in a first direction oriented towards magnetic structure 34 of the switching member. Next, the control member is pivoted in a plate 50, which also forms an axial stop for this control member, in a second direction opposite to the first direction. To limit friction, it is advantageously possible to arrange in plate 50 a bearing with a jewel hole and an endstone, the latter being positioned at the top so that the pivot rests thereon whereas a certain gap remains between the control member body and the upper surface of the plate.

As a result of the arrangement of the switching device according to the invention, when control member 16 is driven step-by-step into the plurality of distinct stable angular positions (2N positions), switching member 12 is subjected to an axial magnetic force alternately in both senses of the direction defined by axis of rotation 36. When the two magnets of the pairs of bipolar magnets 42 and 44, located facing each other, are magnetically oriented in the same sense, the magnetic force is a force of magnetic attraction and the switching member is thus attracted to the control member. Conversely, when the two magnets of these pairs of bipolar magnets 42 and 44 are magnetically oriented in an opposite sense, the magnetic force is a force of magnetic repulsion and the switching member is then repelled away from the control member.

To limit the translation possible for the switching member in the two senses, the timepiece further includes at least a first stop 52 and at least a second stop 54 respectively arranged to define two stable axial positions of the switching member, this switching member abutting against one or other of these first and second stops respectively in its two stable axial positions under the action of the magnetic force produced between the first and second magnetic structures. The two stable axial positions of the switching member respectively define an uncoupling position and a coupling position in which the associated timepiece mechanism is respectively in an uncoupled state and a coupled state. In the case represented in the Figures, coupling wheel 10 is meshed with pinion 6 in the coupling position of the switching member, whereas in the uncoupling position, this coupling wheel is no longer meshed with the pinion (no meshing relation between them). In order to best set the coupling position, stop 54 is height adjustable. In the variant represented, this stop is formed by at least one screw in the threaded hole of bar 30.

Further, means are provided for substantially securing the coupling wheel to the switching member in the axial direction, so that this wheel follows the movement of axial translation of the switching member. In the variant represented, two curved fingers 56 and 58 projecting from the plate of the switching member form therewith two C-shaped elements around the coupling wheel toothing 10A. Thus, this coupling wheel has a very limited axial travel in both senses relative to the switching member. Moreover, by way of improvement, means are provided for allowing optimum rotation of the coupling wheel in the coupling position of the switching member. To this end, to guide the coupling wheel on the side of the switching member plate, arbor 26 of this wheel has a pivot 60 arranged in a lower bearing 62. Next, the upper bearing includes a setting 64 in which are inserted jewel hole 28 and an endstone 66 at a certain distance from the jewel hole, this distance being intended to avoid hindering the sliding of arbor 26 through the jewel hole when the switching member is pushed into its coupling position by a force of magnetic repulsion.

Various variants may be envisaged by those skilled in the art. Thus, although the toothing of pinion 6 is shown as cylindrical, in a variant with axially oriented teeth, the toothings of coupling wheel 10, of pinion 6 and of wheel 8 may advantageously be conical in a first variant, and flat and ring-shaped in a second variant. In this latter case, the toothings may be of the Breguet type, namely saw-teeth ensuring reliable driving in a given direction of rotation, or in the shape of an isosceles triangle for driving in both directions of rotation of the coupling wheel. It is thus clear that a coaxial system may be provided between the coupling wheel and an input wheel or an output wheel, of the type presented in the prior art, with a friction coupling or a coupling with flat annular toothings. Various variants may also be envisaged in such a case. In particular, it will be noted that bar 30 and the bearing that it carries (notably jewel hole 28) are not indispensable, as the coupling wheel could be guided in rotation by other means. By way of example, such guiding in rotation may be achieved by elements acting on circular lateral surfaces of the coupling wheel, either on its toothing, on a lower pivot in a lower bearing (i.e. on the side of magnetic structure 34) or on an intermediate annular part between the plate comprising the coupling toothing (or possibly a friction joint) and a lower pivot.

The pivoting may also be achieved by a ball bearing type device also ensuring an axial connection (i.e. during axial translations) between the coupling wheel and the switching member. It will also be mentioned that, although the coupling wheel is arranged in the Figures for coupling two wheel sets in the coupled state of the mechanism in question, it is also possible for the coupling wheel to carry an indicator or a cam which is actuated depending on whether or not the coupling wheel is meshed with a mobile input element as a function of the angular position of the control member. Finally, it will be noted that guiding in rotation only on the lower side of the coupling wheel and an axial connection may be achieved by a lower magnetic bearing of the type described in the variant presented below.

Figure 4:
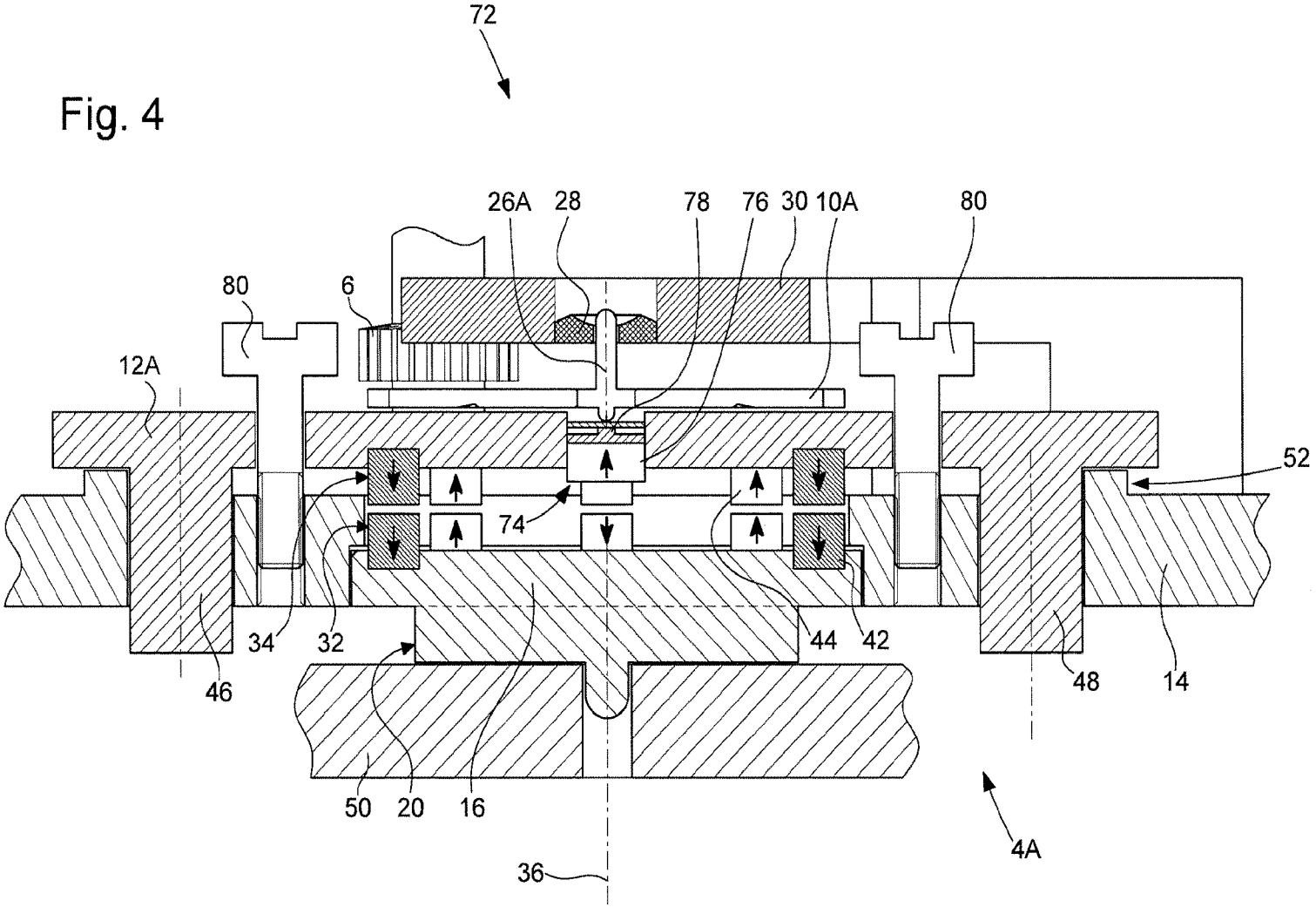
FIG. 4 is a partial cross-sectional view of a variant of the first embodiment.

FIG. 4 shows a variant of the first embodiment. Those elements that have been previously described will not be described again here. Timepiece 72 differs from timepiece 2 firstly in the arrangement, in switching device 4A, of a lower magnetic bearing 74 in place of a conventional bearing with a jewel hole and endstone. This magnetic bearing includes a magnet 76 mounted in the plate of switching member 12A and surmounted by a ferromagnetic element 78 for the central conduction of the magnetic flux from said magnet in order to centre arbor 26A of coupling wheel 10A, said arbor also being at least partially made of ferromagnetic material for the magnetic bearing to be functional. The arrangement of such a magnetic bearing has various advantages. In particular, the force of attraction produced by the magnetic bearing on the coupling wheel arbor allows this wheel to be secured to switching member 12A without the use of mechanical means as in the variant of FIG. 1. In other words, the magnetic bearing is arranged inside the switching member to pivot one end of this arbor, the magnetic bearing further ensuring a synchronous axial movement of the coupling wheel with the switching member in both senses. It is also possible to dispense with the endstone in the upper bearing arranged in bar 30.

In the variant of FIG. 4, the limitation of axial translation of switching member 12A, in the configuration wherein magnetic structures 32 and 34 exhibit therebetween a force of repulsion, and the stable axial coupling position for this switching member (in the example considered) are obtained using two screws 80 (only one is sufficient) freely traversing corresponding holes in the switching member plate and screwed into two threaded holes provided in base 14. In a variant, the two screws 80 also serve to define the axial guiding of the switching member and the two columns 46 and 48 are omitted. Thus, the switching member is simply formed by a disc carrying bipolar magnets.

Figure 5:
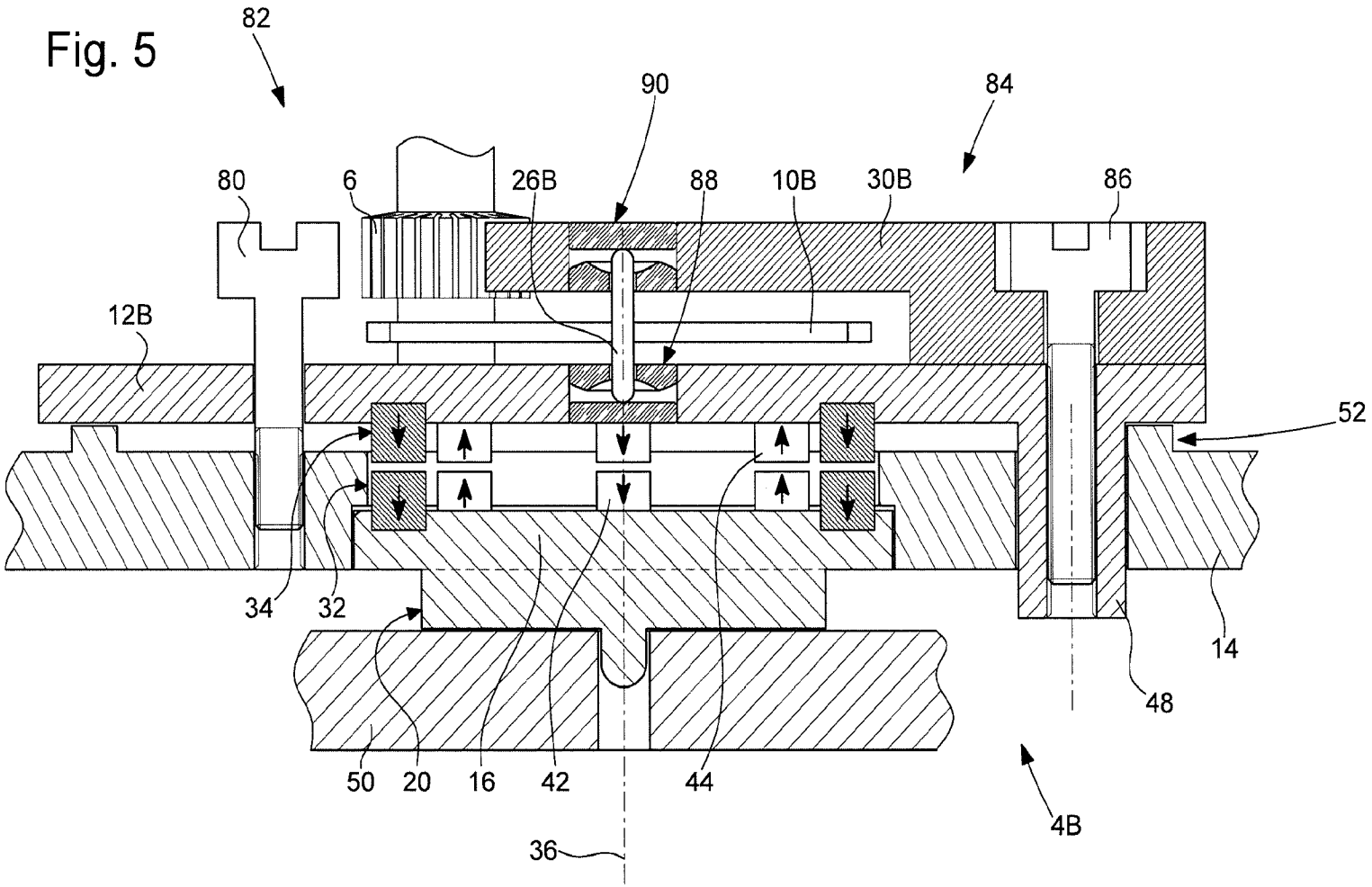
FIG. 5 is a partial cross-sectional view of a timepiece according to a second embodiment of the invention.

FIG. 5 shows a cross-sectional view of a second embodiment of the invention. Once again, elements that have been previously described will not be described again. Timepiece 82 according to this second embodiment is characterized in that the switching device 4B includes a bar 30B which is integral with switching member 12B, such that they form, together with coupling wheel 10B, a coupling unit 84 which can be subjected to an axial movement in one sense and then in the other sense when control member 16 is driven step-by-step into two of its successive stable angular positions. This coupling unit is robust and easy to assemble. In particular, arbor 26B of coupling wheel 10B is pivoted in a conventional manner in two standard bearings 88 and 90 with normal play which remains invariable during operation of the coupling device in this second embodiment. Bar 30B is fixed on the switching member by a screw 86 screwed into a threaded hole in the switching member, this hole advantageously being coaxial with an axial guide column 48 of the coupling unit. It will be noted here that, in order to precisely align the two bearings 88 and 90 in a vertical direction, means for positioning bar 30B may advantageously be provided, notably two positioning pins or screw feet for attaching the bar. The bar is thus fixedly mounted on the switching member to allow at least a central part of a coupling element to be housed between said bar and member, the bar including a bearing in which is arranged one end of the coupling element arbor. It will be noted that a column has been removed relative to the first embodiment, since the axial guiding of the switching member is achieved by screw 80 and column 48. Screw 80 thus has a second function here.

Figure 6:
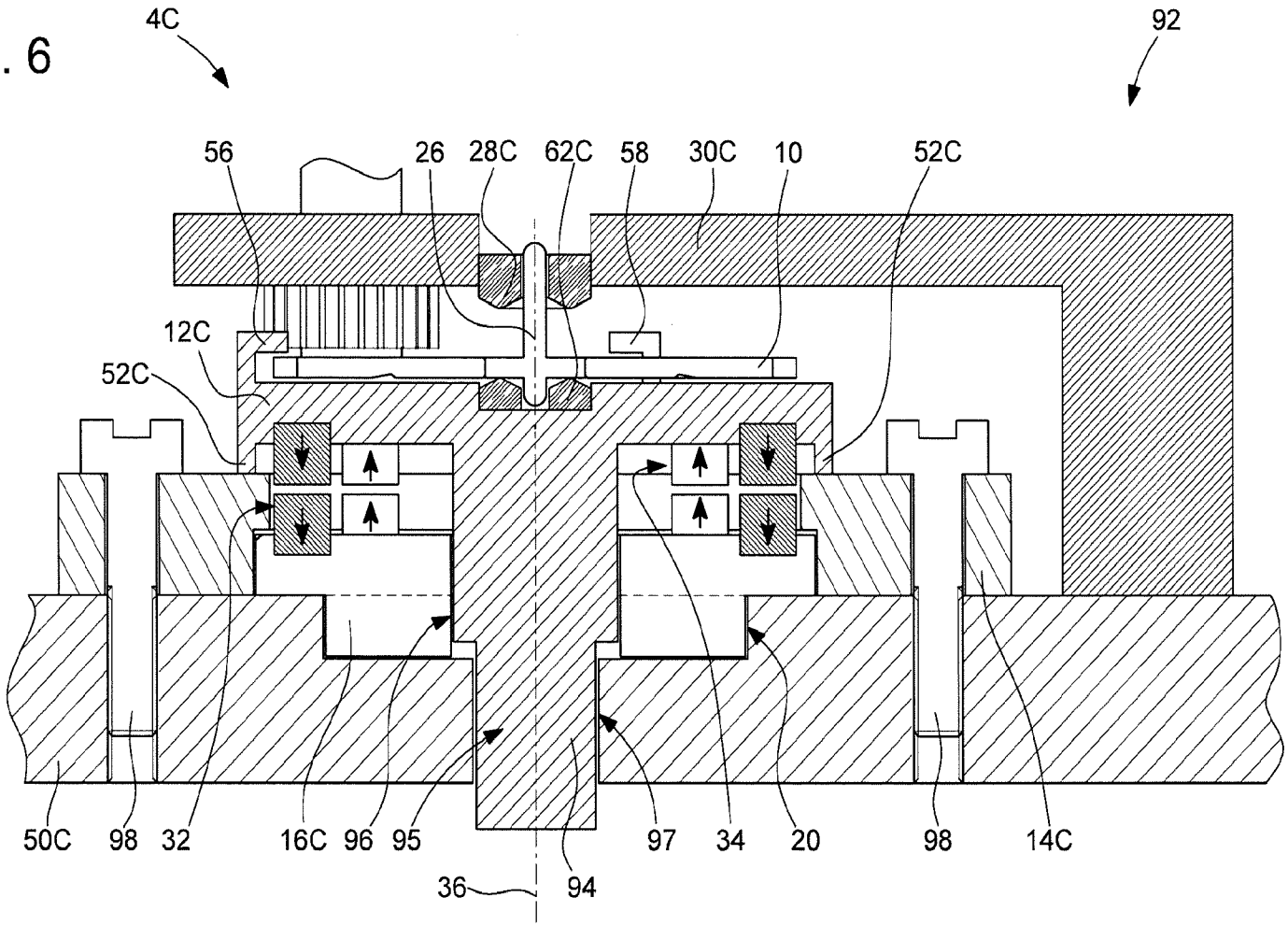
FIG. 6 is a partial cross-sectional view of a timepiece according to a third embodiment of the invention.

FIG. 6 shows a third embodiment of a timepiece 92 according to the invention. Once again, only differences with the preceding embodiments will be explained. It will be noted that the operation of the magnetic system of switching device 4C remains identical to that described previously and will not therefore be explained here. This third embodiment differs from the first embodiment mainly in that switching member 12C is axially guided by a central column 94 freely traversing a cylindrical hole 96 in control member 16C and extends into a non-circular hole 97 in a plate 50C on which the control member is mounted. A disc 14C, defining, with the plate, a housing for this control member, is fixed to the plate by two screws 98. Column 94 has, on at least a lower portion 95, sliding into non-circular hole 97, a non-circular cross-section corresponding to the profile of this non-circular hole, so as to prevent rotation of the switching member, in particular when control member 16C is driven in rotation to move the switching member between its two stable axial positions, as explained above. The portion 95 of non-circular cross-section is configured to allow an axial translation of the switching member between its two stable axial positions.

This third embodiment is advantageous since switching device 4C is more compact than the two preceding embodiments.

Star 20 may be actuated by a lever or an element sliding through a lateral aperture provided in plate 50C. It will be noted that projecting portions 52C of switching element 12C, defining the axial uncoupling position of this switching member, move into abutment against the upper surface of base/stop 14C.

As particular variants, the following specific features may be mentioned:

the two curved fingers 56 and 58, substantially used for securing coupling wheel 10 to the switching member during axial translations of the latter, are not arranged diametrically opposite to each other here, but on either side of pinion 6 with an angular distance of less than 180° therebetween, for example 120°. This ensures that wheel 10 does not mesh with pinion 6 in the axial uncoupling position of the switching member and moreover facilitates the arrangement of this wheel with a lower pivot of arbor 26 in a jewel hole 62C.

Curved fingers 56 and 58 also have the function of defining stops for the switching member to define its axial coupling position, since the fingers abut against the lower surface of the plate of wheel 30C in this position.

jewel holes 28C and 62C, respectively forming two bearings for the coupling wheel, have annular portions which protrude slightly respectively from the lower surface of the plate of bar 30C and from the flat surface of the switching member facing the coupling wheel, so as to hold the wheel at a certain distance from these two flat surfaces in the axial coupling position of the switching member and also from fingers 56 and 58. Friction is thus limited on the coupling wheel when it is driven in rotation and the loss of mechanical energy is thereby diminished in this coupled state of the timepiece mechanism associated with the switching device. As in the first embodiment, jewel hole 28C may be arranged in a setting whose axial position is adjustable.

It will be noted that the second embodiment may advantageously be implemented in a timepiece according to the third embodiment.

As indicated previously, the control member can be actuated by a user via an actuation device such as a push-piece. Other actuation devices known to those skilled in the art may be envisaged. Thus, in other embodiments, these actuation mechanisms may be automatically actuated, especially periodically by another mechanism of the timepiece, i.e. by an actuation mechanism of the timepiece that cooperates with the switched mechanism according to the invention. The invention can be applied to mechanical timepiece movements and also to timepieces having electromechanical parts. Thus, the device for actuation of the control member may have an electromechanical motor.

Finally, although the various embodiments represented in the Figures all concern switching devices with a switching member formed by a shuttle-like element subjected to general to-and-fro motions along a vertical axis, it will be noted that other embodiments may be envisaged within the scope of the present invention, in particular switching devices with a switching member formed by an element pivoting about a horizontal axis, i.e. in the general plane of the control member and thus orthogonal to its axis of rotation. By way of example, this pivoting element is a lever or pivoting part including one portion, on the side of its pivot axis, that carries the second magnetic structure. The pivoting element is arranged such that the second magnetic structure, notably formed by a bipolar magnet, is subjected to a movement along an arc of a circle whose vertical dimension is greater than its horizontal dimension. Thus, the portion bearing the second magnetic structure is subjected, according to the present invention, to a translatory motion in both directions between two stable axial positions when the control member is rotated step-by-step into its distinct angular positions.

What is claimed is:

1. A timepiece including:

a timepiece mechanism capable of switching between a specific first state and a specific second state;

a switching device arranged to be able to switch the timepiece mechanism between said first and second states, said switching device including a control member, which extends in a general plane in which it is subjectable to a movement under the action of an actuation device of said control member, and a switching member at least one part of which is arranged to be subjectable to a movement having a component orthogonal to said general plane;

the switching device being arranged such that said at least one part of the switching member is capable of passing on demand from a first stable axial position to a second stable axial position, to cause a first switch of the timepiece mechanism between the first state and second state thereof, and from the second stable axial position to the first stable axial position to cause a second switch of the timepiece mechanism between the second state and the first state thereof;

wherein the control member is arranged to pivot about an axis of rotation which is perpendicular to said general plane, so as to be drivable step-by-step in a given direction of rotation, successively into a plurality of distinct angular positions; wherein the control member and the switching member respectively include a first magnetic structure and a second magnetic structure arranged to exhibit a magnet interaction therebetween; wherein one of the first and second magnetic structures includes at least a first magnetic pole and the other of said two magnetic structures includes at least a second magnetic pole and a third magnetic pole with opposite polarities, the first and second magnetic structures being arranged such that, in a first angular position of the control member of said plurality of distinct angular positions, the first magnetic pole mainly exhibits a first magnetic interaction with one of the second and third magnetic poles, and such that, in a second angular position of this control member of the plurality of distinct angular positions, this first magnetic pole mainly exhibits a second magnetic interaction with the other of the second and third magnetic poles, the first and second magnetic interactions producing on the switching member a first magnetic force and a second magnetic force respectively, both mainly oriented along said axis of rotation in opposite directions, allowing said at least one part of said switching member to be moved from the first stable axial position to the second stable axial position and vice versa; and wherein said at least one part of the switching member is subjected to an alternate movement between the first and second stable axial positions thereof when the second magnetic structure is driven in rotation step-by-step in said given direction of rotation.

2. The timepiece according to claim 1, wherein the control member is arranged to make steps each corresponding to a pivoting motion of angle $\pi/N$, where $N>0$, such that the first magnetic structure is made to occupy in succession 2N distinct angular positions about said axis of rotation when driven step-by-step, said one of the first and second magnetic structures including N first magnetic poles which are substantially axially oriented and, when $N>1$, regularly distributed about said axis of rotation, and said other of said two magnetic structures including N second magnetic poles and N third magnetic poles which are substantially axially oriented and regularly distributed about the axis of rotation and at substantially the same distance from said axis of rotation as the first magnetic poles, the second and third magnetic poles being arranged alternately, such that each second magnetic pole is inserted between two third magnetic poles; and wherein, in each of the distinct angular positions of the control member, the N first magnetic poles are located substantially facing the N second magnetic poles or N third magnetic poles.

3. The timepiece according to claim 2, wherein said one of the first and second magnetic structures further includes N fourth magnetic poles of opposite polarity to those of the N first magnetic poles, the first and fourth magnetic poles being regularly distributed about said axis of rotation and arranged alternately such that each fourth magnetic pole is inserted between two first magnetic poles.

4. The timepiece according to claim 3, wherein said one of the first and second magnetic structures is formed by a multipolar magnetic comprising 2N alternate and axially oriented poles.

5. The timepiece according to claim 3, wherein said one of the first and second magnetic structures includes 2N bipolar magnets, axially oriented and regularly distributed about said axis of rotation, said bipolar magnets being alternately magnetically oriented in one sense and then the other.

6. The timepiece according to claim 2, wherein said other of the first and second magnetic structures is formed by a multipolar magnet including 2N alternate and axially oriented poles.

7. The timepiece according to claim 2, wherein said other of the first and second magnetic structures includes 2N bipolar magnets, axially oriented and regularly distributed about said axis of rotation, said bipolar magnets being alternately magnetically oriented in one sense and then the other.

8. The timepiece according to claim 1, wherein said switching member includes axial guiding arranged to allow an axial translation in both directions of said switching member when said control member is actuated in rotation and to prevent said switching member being driven in rotation upon such actuation.

9. The timepiece according to claim 8, wherein the timepiece further includes a first stop and a second stop arranged to define respectively the two stable axial positions of the switching member, said switching member abutting against one or other of said first and second stops in the two respective stable axial positions thereof under the action of the magnetic force produced between the first and second magnetic structures.

10. The timepiece according to claim 8, wherein said switching device forms a coupling/uncoupling device, and wherein said switching member carries a coupling element including a central arbor and arranged to rotate freely in at least one axial position of said first and second stable axial positions, corresponding to a coupled position of the switching device, the coupling element being substantially integral with the switching member in axial translation.

11. The timepiece according to claim 10, wherein the arbor of said coupling element is at least partly formed of a ferromagnetic material, and wherein a magnetic bearing is arranged inside said switching member to pivot one end of said arbor, said magnetic bearing further ensuring an axial movement of a coupling wheel which is synchronous with that of the switching member in both directions.

12. The timepiece according to claim 10, wherein one part of said arbor, located on an opposite side to the switching member, is arranged to slide in a jewel hole, said jewel hole forming a bearing mounted in a bar or a plate integral with a base on which is mounted the control member, the coupling element being located at least partly between the bar or the plate and the base.

13. The timepiece according to claim 10, wherein a bar is fixedly mounted on the switching member to allow at least a central part of said coupling element to be housed between said bar and member, the bar including a bearing in which is arranged one end of the arbor of said coupling element.

14. The timepiece according to claim 8, wherein said switching member is guided in axial translation by at least one column located at the periphery of said control member.

15. The timepiece according to claim 14, wherein the control member includes a star associated with an element for driving said control member in rotation step-by-step and with a jumper for stabilising the control member successively in the angular positions of said plurality of distinct angular positions, the star including a number of branches equal to the number of said angular positions.

16. The timepiece according to claim 8, wherein said switching member is guided in axial translation by a central column which traverses a central circular hole in said control member and extends into a non-circular hole in a plate on which is mounted said control member, said column having, on at least one portion sliding into the non-circular hole, a non-circular cross-section corresponding to the profile of said non-circular hole.

17. The timepiece according to claim 16, wherein the control member includes a star associated with an element for driving said control member in rotation step-by-step and with a jumper for stabilising the control member successively in the angular positions of said plurality of distinct angular positions, the star including a number of branches equal to the number of said angular positions.

* * * * *